United States Patent [19]

Knecht et al.

[11] Patent Number: 4,613,750

[45] Date of Patent: Sep. 23, 1986

[54] METHOD OF AND DEVICE FOR CHECKING FOR THE PRESENCE OF A SHEET OF MATERIAL

[75] Inventors: Siegfried Knecht, Gevelsberg; Jürgen Wiesejahn, Recklinghausen, both of Fed. Rep. of Germany

[73] Assignee: Maschinenfabrik Alfred Schmermund GmbH & Co., Gevelsberg, Fed. Rep. of Germany

[21] Appl. No.: 549,227

[22] Filed: Nov. 4, 1983

[30] Foreign Application Priority Data

May 11, 1983 [DE] Fed. Rep. of Germany ..... 3240825

[51] Int. Cl.[4] ..... G01N 9/04

[52] U.S. Cl. ..... 250/223 R; 226/181

[58] Field of Search ..... 226/45, 181–187; 250/548, 557, 223 R, 561; 209/530, 531, 533

[56] References Cited

U.S. PATENT DOCUMENTS

| | | | |
|---|---|---|---|
| 3,886,338 | 5/1975 | Lockun et al. | 226/45 |
| 3,889,111 | 6/1975 | Moss | 250/548 |
| 3,917,142 | 11/1975 | Guarderas | 226/45 |
| 4,145,608 | 3/1979 | Shirasaki et al. | 250/231 SE |

*Primary Examiner*—David C. Nelms

[57] ABSTRACT

The presence and/or desired orientation of a sheet of material is sensed by normally passing the sheet under the first of two spaced rollers of identical diameter, the rollers being mounted on a common support for rotation independently of one another. The second roller will rotate only in the absence of or misalignment from under the first roller of the sheet material. Rotation of the second roller is detected and causes generation of a fault warning.

10 Claims, 2 Drawing Figures

METHOD OF AND DEVICE FOR CHECKING FOR THE PRESENCE OF A SHEET OF MATERIAL

BACKGROUND OF THE INVENTION (1) Field of the Invention

The present invention relates to the detection of the presence of sheet material and particularly to ascertaining whether a strip of material, which is to be or has been bonded to an underlying sheet of material, is being fed in proper alignment with the underlying sheet. More specifically, this invention is directed to apparatus for providing a warning signal in the absence of thin sheet material and especially to apparatus for sensing the presence of a strip of thin transparent foil which, for example, is to be bonded to a sheet of foil. Accordingly, the general object of the present invention are to provide novel and improved methods and apparatus of such character.

(2) Description of the Prior Art

While not limited thereto in its utility, the present invention is particularly well-suited for use in packaging and particularly in the wrapping of products, such as cigarettes, which are hermetically sealed to insure freshness. As is well-known, cigarette packages are wrapped in a transparent, for example, polypropylene, foil. This wrapping is typically provided with a tear strip or band to facilitate opening of the packages. The tear-open band is usually comprised of a transparent material and is welded or glued, in the wrapping machine, to the transparent foil. Since a faulty package would result from the absence or breakage of the tear-open band, means must be provided to stop the wrapping machine if the tear-open band breaks or the supply thereof to the wrapping machine is interrupted for any reason. The failure of the tear-open band may be easily detected during its delivery to the point where it is brought into abutting relationship with the wrapping foil. For example, the band may be passed over a compensating roller which is connected to a suitable sensor, the sensor detecting either the failure of the roller to rotate or the absence of force on the roller.

Continuing to discuss the cigarette packaging application, faulty wrapping will also occur when the tear-open band departs from the desired alignment, i.e., the tear-open band will be skewed relative to a desired feed direction. Any such misalignment may result in the tear-open band failing to pass the gluing or welding device by which it is bonded to the wrapping foil. Such misalignment is difficult to detect. For example, a transparent tear-open band cannot be detected optically. The cigarette industry has, accordingly, previously resorted to use of visual inspection, by attendance personnel, to insure that a tear-open band is being properly delivered into abutting relationship with a wrapping foil. It has long been desired to automate this monitoring procedure, particularly since the attendance personnel typically have other tasks to perform and it is thus possible for a substantial number of faulty packages to be formed before a tear-open band feed problem has been noted and corrected.

Apparatus for controlling the position of the edge of a fabric or paper sheet, wherein plural rolls mounted independently of one another are employed, is known in the art. An example of such prior apparatus may be seen from German patent specification No. 736,136. In this type of prior art device the sheet of material, the position of which is to be controlled, moves under the rollers, the rollers individually controlling the state of electrical contacts. Should the sheet of material not be present under at least one roller, the state of the associated contacts will change and a fault signal will be generated. In response to this fault signal, the edge of the sheet of material may be shifted sideways to an appropriate extent while the material feed speed is reduced. This type of prior art control apparatus would not, however, be applicable to determining the presence and direction of delivery of a tear-open band which is being brought into abutting contact with an underlying sheet.

SUMMARY OF THE INVENTION

The present invention overcomes the above-briefly discussed and other deficiencies and disadvantages of the prior art and, in so doing, tests for the presence and proper alignment of a sheet of material, a thin transparent band for example, which is being or has been bonded to a surface of a second wider sheet of material. The present invention also encompasses apparatus for use in the aforesaid testing procedure.

Apparatus in accordance with the present invention employs a pair of rollers supported from a common pivotal lever but mounted independently of one another. The rollers are situated next to one another such that when a first roller is in contact with the narrow band the second roller will be displaced from the underlying sheet to which the band is to be bonded. The apparatus further comprises means for determining the state of motion of the second roller. Should the second roller begin to rotate, indicating that the band is no longer is registration with the first roller thus permitting the second roller to contact the underlying sheet, a fault warning will be generated.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENT

Figure 1:
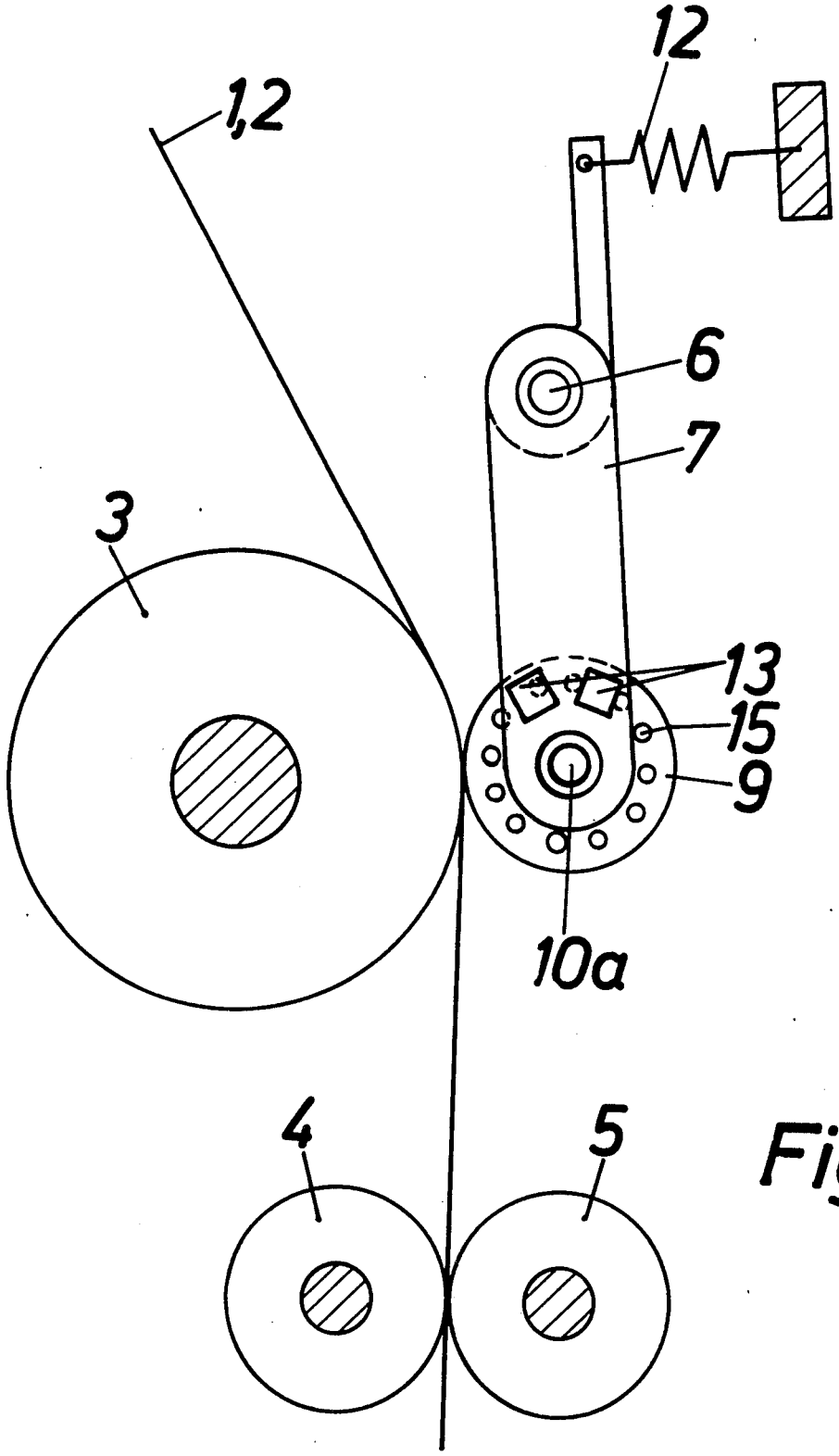
FIG. 1 is a schematic side-elevation view of apparatus in accordance with a preferred embodiment of the invention, the apparatus of FIG. 1 comprising a portion of a mechanism for feeding a foil provided with a tear-open band to a wrapping machine.

The present invention is shown in the drawing in the environment of a wrapping machine which comprises, for example, part of a cigarette packaging installation. In this wrapping machine a foil sheet 2, provided with a tear-open band 1, is normally pulled over a deflecting or feed roller 3 by means of a pair of counter-rotating drive rolls 4 and 5. The means for detecting the presence and position of the tear-open band 1 comprises a pair of rollers 8 and 9 of the same diameter. The rollers 8 and 9 are mounted for independent rotation, by means of needle bearing 10, about an axle or pivot pin 10*a*. The pin 10*a* is supported from a fork-shaped lever 7. The lever 7 is pivotal about a further axle or pivot pin 6. A separator ring 11 prevents rotation of roller 8, which in the disclosed embodiment will be in contact with the surface of the tear-open band 1 during normal operation, from being transmitted to roller 9. Thus, under normal operating conditions, roller 9 will be stationary and the distance between roller 9 and the surface of foil sheet 2 will correspond to the thickness of the tear-open band 1. This distance is typically in the range of 4/100 to 5/100 mm. While small, this distance is sufficient to insure that roller 9 will remain stationery under normal operating conditions.

Figure 2:
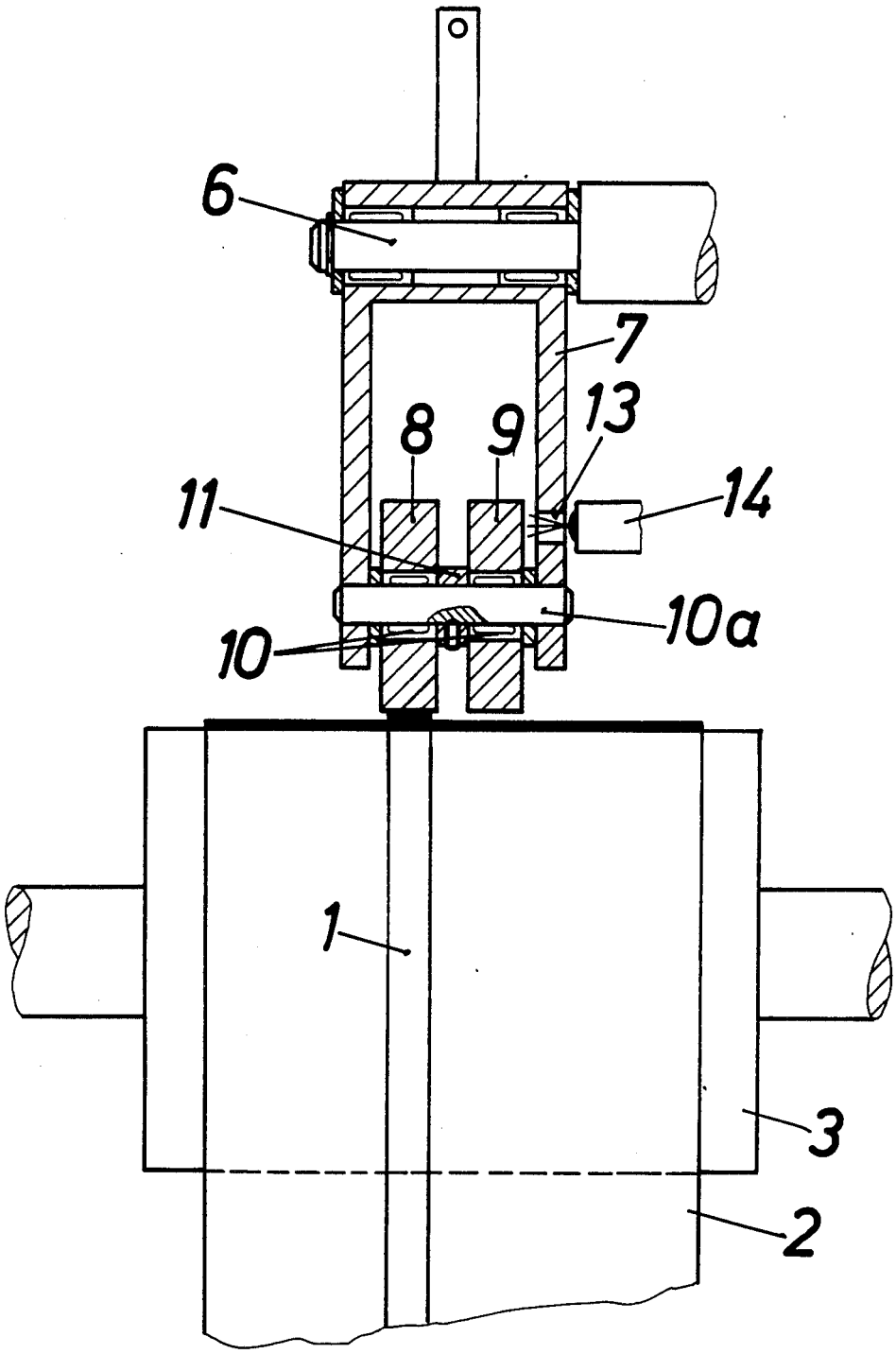
FIG. 2 is a plan view of the apparatus of FIG. 1 with the present invention being shown on an enlarged scale.

If the tear-open band 1 is missing, or if band 1 runs out of aligment, to the left as the apparatus is depicted in FIG. 2, both of rollers 8 and 9 will contact the surface of foil sheet 2. This contact will result from the biasing of fork 7 in the direction of roll 3 which is produced by spring 12 (FIG. 1). If the tear-open band 1 runs out of alignment to the right, it will pass beneath roller 9. Thus, misalignment to either the right or left or the absence of the tear-open band 1 will result in the rotation of roller 9.

Referring jointly to FIGS. 1 and 2, the lever 7 is provided with a pair of bores 13. A photocell 14 is mounted in front of each of the bores 13. The roller 9 is provided with indicia or markings 15. The spacing between the markings 15 on its side surface differs from the spacing of the axes of the photocells 14. This difference in spacing assures that a fault signal will not be generated should one of the markings 15 by chance be positioned in alignment with one of the photocells 14, i.e., the condition of rotation of roller 9 cannot be falsely indicated since both photocells cannot simultaneously be alignment with markings 15 on a stationery roller 9. However, when both of the photocells 14 produce an alternating signal, indicative of the passage of markings 15 across the axes of the photocells, roller 9 must be rotating and thus a positive fault or warning signal will be generated and, if deemed advisable, the wrapping machine stopped in response to such signal by means of a suitable device (not shown).

The apparatus of the present invention can, of course, also be used for testing for the presence of a thin strip or band of material since the mode of operation remains the same whether contact with an underlying sheet of material or the surface of roll 3 causes rotation of roller 9.

As will also be obvious to those skilled in the art, rotation detectors other than optical devices, such as the photocells 14, may be employed to distinguish between the state of rest and the state of motion of roller 9. By way of example, capacitive or inductive pick-ups can be utilized in which case the roller 9 would be comprised of non-conductive material and carry markings comprising conductive or ferromagnetic material. The markings 15 can also be arranged on the end or material contacting surface of roller 9 in which case the sensors would have to be repositioned and, if appropriate, made pivotal with the lever 7.

It is to be understood that the invention is not limited to the illustration described and shown herein, which is deemed to be merely illustrative of the best mode of carrying out the invention and which is susceptible to modification of form, size, arrangement of parts and details of operation. The invention rather is intended to encompass all of such modifications which are within its spirit and scope as defined by the claims.

What is claimed is:

1. Apparatus for testing for the presence of sheet material being passed over a feed surface comprising:
- a first pick-up roller;
- a second pick-up roller;
- means supporting said first and second pick-up rollers for independent rotation about a common axis;
- means for biasing said supporting means toward the feed surface over which the material is passed;
- means for detecting rotation of said second pick-up roller resulting from establishment of contact between said second roller and the sheet material and generating the warning signal commensurate therewith, the sheet material contacting only said first pick-up roller and the feed surface and not contacting said second pick-up roller when properly aligned whereby rotation of said second pick-up roller is indicative of the absence or misalignment of the sheet material.

2. The apparatus of claim 1 wherein said detecting means comprises:
- a plurality of spaced markings on said second pick-up roller; and
- an optical sensor, said optical sensor detecting the passage of said spaced markings on said second pick-up roller.

3. The apparatus of claim 2 wherein said optical sensor includes a photocell having an optical axis and wherein said apparatus further comprises:
- a second photocell having an optical axis, said second photocell being positioned to detect the passage of said markings, the spacing between the axes of said photocells being different than the spacing between the markings, a warning signal being produced only when both photocells detect the passage across the optical axes thereof of said markings.

4. The apparatus of claim 1 further comprising:
- spacer means for maintaining separation between said pick-up rollers.

5. The apparatus of claim 1 wherein said supporting means comprises a pivotal lever.

6. The apparatus of claim 5 wherein said biasing means comprises a spring connected to said lever.

7. The apparatus of claim 1 wherein said detecting means comprises:
- spaced plural indicia producing means on said second pick-up roller; and
- a pair of spacially displaced motion sensors, said motion sensors being responsive to said indicia producing means on said second pick-up roller, the spacing between said indicia producing means on said second pick-up roller being different than the spacing between said motion sensors.

8. The apparatus of claim 7 wherein said supporting means comprises a pivotal lever.

9. The apparatus of claim 8 wherein said biasing means comprises a spring connected to said lever.

10. The apparatus of claim 9 wherein said motion sensors each comprise:
- a photocell; and
- wherein said indicia producing means comprises:
  - a plurality of spaced markings on said second pick-up roller, the movement of said markings past said photocells produced alternating output signals from said photocells.

* * * * *